US008870624B2

(12) United States Patent
Hopkins

(10) Patent No.: US 8,870,624 B2
(45) **Date of Patent: *Oct. 28, 2014**

(54) ACTIVE WEAR APPAREL

(71) Applicant: Natascha Hopkins, Beverly Hills, CA (US)

(72) Inventor: Natascha Hopkins, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/747,156

(22) Filed: Jan. 22, 2013

(65) Prior Publication Data

US 2013/0130591 A1 May 23, 2013

Related U.S. Application Data

(63) Continuation of application No. 12/805,102, filed on Jul. 13, 2010, now Pat. No. 8,376,808.

(51) Int. Cl.

| | |
|---|---|
| ***A41C 3/00*** | (2006.01) |
| ***A41D 1/22*** | (2006.01) |
| ***A41C 3/08*** | (2006.01) |

(52) U.S. Cl.

CPC ..... *A41C 3/08* (2013.01); *A41C 3/0057* (2013.01); *A41D 1/22* (2013.01); *A41D 2400/60* (2013.01); *A41D 2600/10* (2013.01)

USPC ..... 450/31; 450/17; 450/23

(58) Field of Classification Search

USPC ..... 450/30–33, 17, 23, 34, 58, 70, 92, 93; 2/78.1–78.4, 69, 105, 106

See application file for complete search history.

(56) References Cited

U.S. PATENT DOCUMENTS

| | | | | | |
|---|---|---|---|---|---|
| 4,289,137 | A | * | 9/1981 | Dell et al. | 450/58 |
| 4,538,614 | A | * | 9/1985 | Henderson | 450/70 |
| 4,816,005 | A | * | 3/1989 | Braaten | 450/58 |
| 5,109,546 | A | | 5/1992 | Dicker et al. | |
| 5,159,716 | A | * | 11/1992 | Takata | 2/2.16 |
| 5,176,600 | A | | 1/1993 | Wilkinson | |
| 5,186,701 | A | | 2/1993 | Wilkinson | |
| 5,201,074 | A | | 4/1993 | Dicker | |
| 5,306,222 | A | | 4/1994 | Wilkinson | |
| 5,570,472 | A | | 11/1996 | Dicker | |
| 5,700,231 | A | | 12/1997 | Wilkinson | |
| 5,708,976 | A | | 1/1998 | Dicker | |
| 5,720,042 | A | | 2/1998 | Wilkinson | |
| 5,727,254 | A | | 3/1998 | Dicker | |
| 5,737,772 | A | | 4/1998 | Dicker et al. | |
| 5,737,773 | A | | 4/1998 | Dicker et al. | |
| 5,778,452 | A | | 7/1998 | Dicker et al. | |
| 5,839,122 | A | | 11/1998 | Dicker et al. | |
| 5,857,947 | A | | 1/1999 | Dicker | |
| 5,867,827 | A | | 2/1999 | Wilkinson | |
| 6,083,080 | A | * | 7/2000 | Lawson et al. | 450/39 |
| 6,110,005 | A | * | 8/2000 | Stephenson et al. | 450/39 |
| 6,176,761 | B1 | * | 1/2001 | Underhill | 450/89 |

(Continued)

*Primary Examiner* — Gloria Hale

(74) *Attorney, Agent, or Firm* — Brooks Kushman P.C.

(57) ABSTRACT

A clothing is disclosed and includes a top configured to cover a user's upper body, the top including a breast area configured to cover a user's breasts; a pair of bra cups embedded into the top and positioned on the breast area, the bra cups configured to support the user's breasts; at least one elastic band positioned adjacent to the bra cups and on the breast area, the elastic band configured to aid the bra cups in supporting to the user's breasts; and a perspiration promoting material positioned within the top and configured to cause the user to perspire.

18 Claims, 18 Drawing Sheets

(56) References Cited

U.S. PATENT DOCUMENTS

| | | | | |
|---|---|---|---|---|
| 6,231,488 | B1 | 5/2001 | Dicker et al. | |
| 6,237,152 | B1 * | 5/2001 | Gootrad | 2/87 |
| 6,446,273 | B1 * | 9/2002 | Gillen et al. | 2/455 |
| 6,517,410 | B1 * | 2/2003 | Underhill | 450/1 |
| 8,075,366 | B1 * | 12/2011 | Jaksic et al. | 450/30 |
| 8,376,808 | B2 * | 2/2013 | Hopkins | 450/30 |
| 2001/0019933 | A1 * | 9/2001 | Wagner | 450/37 |
| 2003/0096557 | A1 * | 5/2003 | Waitz | 450/1 |
| 2010/0045967 | A1 * | 2/2010 | Moir | 356/28 |
| 2012/0142252 | A1 * | 6/2012 | Hopkins | 450/31 |
| 2013/0130591 | A1 * | 5/2013 | Hopkins | 450/31 |

* cited by examiner

ACTIVE WEAR APPAREL

CROSS-REFERENCE TO RELATED APPLICATIONS

This application is a continuation of U.S. application Ser. No. 12/805,102 filed Jul. 13, 2010, the disclosure of which is incorporated in its entirety by reference herein.

TECHNICAL FIELD

This disclosure relates to apparel for active wear.

BACKGROUND

A common article of apparel favored by women athletes and active women is the 'sports bra,' a garment intended both to robustly support the breasts during vigorous activity and permit freedom of motion of the arms, shoulders, head, neck, and torso. Another apparel item sometimes worn by persons wishing to accelerate water weight loss through sweating during vigorous physical activity is the non-breathable garment commonly known as the 'sauna suit' or 'sweat-suit.' Although there seems to be a lag in the onset of sweating at the beginning of exercise, it has been well documented that sweating (evaporation) provides the major physiologic defense against overheating. Heat is continually being evaporated through the skin into the environment as water.

The sweating rate of any given individual is dependent upon the climatic conditions/environmental acclimation, the type of clothing worn, and the level of exercise intensity. (Sawka, et al., 1998.) Sawka, et al. conclude that persons wearing protective clothing often have sweating rates of 1 to 2 liters per hour while performing light intensity exercise. Protective clothing such as the nuclear, biological, and chemical (NBC) ensemble worn by military personnel, the protective equipment worn by football players, or the sauna suit features high insulation and low water vapor permeability, due to the thickness and the multilayered fabric design.

This layering effect traps insulative air layers around the body and impairs the transfer of heat to the environment. The limited evaporative heat loss allowed by the protective clothing, combined with an increased metabolic heat production and high ambient temperature, can increase the body's core temperature to dangerously high levels. These conditions define uncompensable heat stress wherein the evaporative cooling requirements (E.sub.req) greatly exceed the maximum evaporative potential (E.sub.max), which maintains thermal equilibrium.

It is not uncommon, therefore, for conditions that would normally be defined as compensable heat stress, to become uncompensable when protective clothing is worn (McLellan, et al., 1999). The heat strain associated with wearing NBC protective clothing has been studied for many different combinations of ambient temperature, vapor pressure, and metabolic rate (Carter and Cammermyer, 1985); Kraning and Gonzalez, 1991; McLellan, 1993; Montain, et at. 1994). U.S. Pat. No. 6,231,488 issued on May 15, 2001 to Dicker, et. al. entitled "Aerobic Exercise Garment" discloses an aerobic resistance garment is particularly designed for warm weather or indoor or high temperature use by including elastic resistance bands and base fabric material wherein the base fabric material is breathable such as by being made from an open mesh or net material.

Various garments have been suggested which include elastic elements to provide a resistance to an activity which would require swinging or bending of the arms or legs or the bending of various body parts. Examples of such garments are found in U.S. Pat. Nos. 5,109,546, 5,176,600, 5,186,701, 5,201,074, 5,306,222 and 5,570,472. One deficiency of current sauna suit designs is that they are generally baggy, unfitted garments designed as a unisex or one-size-fits-all item. No known sauna suits provides integrated support for the breasts, thereby requiring that a bra or sports bra be worn underneath the sauna suit to insure adequate support during physical activity. A further deficiency of current sauna suit designs is that they may require the wearer to don undergarments first, then the sauna suit.

A further deficiency of current designs is that many undergarments are not designed to endure the high degree of saturation of sweat which occurs when the undergarments are worn with a sauna suit, and may therefore be damaged, or the undergarment life may significantly be reduced. A further additional deficiency is that some individuals may choose to wear a sauna suit under 'regular' clothing, in order to continue the accelerated water weight loss process while engaged in activities requiring 'normal' clothes; and, as most sauna suits are quite baggy and un-fitted, the ability to comfortably conceal them under a 'regular' clothing is limited at best. One additional deficiency of current designs is the lack of an absorbent lining to absorb sweat, thereby preventing it from running down the user's body and possibly wetting or staining their clothing or footwear.

There are many known sports bras and sauna suits, but each suffers deficiencies when an attempt is made to utilize them together, particularly under clothing. There is no known garment which combines the functionality and benefits of a sports bra, a sauna suit, and a fitted garment which may be worn alone or under clothing.

There exists a need for aerobic garments to act as a fitted sauna suit, thereby permitting the garment to be worn under a clothing. There is also a need for a fitted sauna suit, which facilitates an aesthetically pleasing shape to and support for the wearer's breasts, buttocks, and torso, and/or thighs. There is yet a need for such garments to have an absorbent material to absorb the sweat produced by the user to avoid introduction of sweat into the user's clothing or footwear. It is also desirable, if not mandatory, that such fitted sauna suits can tolerate the conditions of use including high moisture exposure and robust activity. The present invention fulfills such needs.

SUMMARY

The present disclosure discloses a clothing that includes a top configured to cover a user's upper body, the top including a breast area configured to cover a user's breasts; a pair of bra cups embedded into the top and positioned on the breast area, the bra cups configured to support the user's breasts; at least one elastic band positioned adjacent to the bra cups and on the breast area, the elastic band configured to aid the bra cups in supporting to the user's breasts; and a perspiration promoting material positioned within the top and configured to cause the user to perspire.

The present disclosure also discloses a clothing including a top configured to cover a user's upper body, the top including a pair of sleeves configured to cover a user's arms, the pair of sleeves including an internal portion configured to directly contact the user's arms and an external portion opposite the internal portion; and a perspiration promoting material positioned on the internal portion of at least one of the sleeves, the perspiration promoting material configured to cause an arm of the user to perspire.

The present disclosure further discloses a clothing including a bottom configured to cover at least a portion of a user's legs, the bottom including a perspiration promoting material positioned on an internal side of the bottom and configured to contact a user's waist and promote perspiration of the user's waist and a covering material positioned on an external side of the bottom and opposite to the perspiration promoting material, the covering material being made of a material that is different from the perspiration promoting material.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
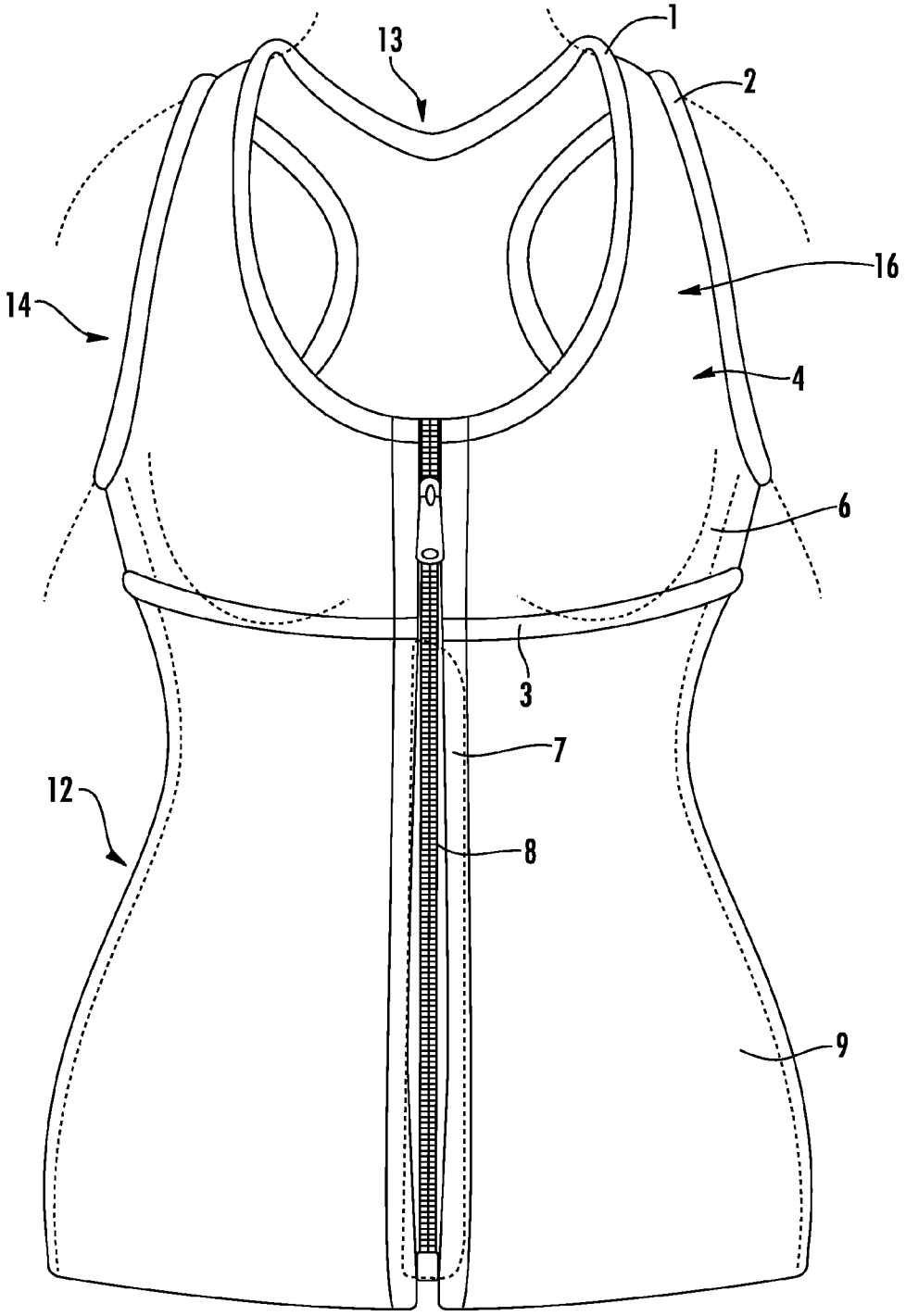
FIG. 1 is a frontal view of a garment embodying teachings of the present disclosure in the closed or zipped configuration.

The present disclosure includes a variety of unique aerobic activity garment structures. The various aerobic activity garment structures may be used in warm weather or high temperature conditions. In FIG. 1, a garment structure may comprise a shirt portion 16 having a body portion with an integral sports bra 4. The garment structure may take the form of a fitted sauna suit 12 with a base skirt having a zipper 8 or other closure for securement. The integral sports bra 4 preferably comprises a second layer of fitted polymeric material 6, such as the clothing material sold under the trademark LYCRA®, for increased support of the breasts and configured to create a moderate lift and extra security for the wearer. A water resistant material 9 with elastic properties such neoprene may be used for the garment structure, or portions thereof, such as the base skirt 9, to promote water weight loss through perspiration and to provide for a comfortable fit for the wearer.

Figure 2:
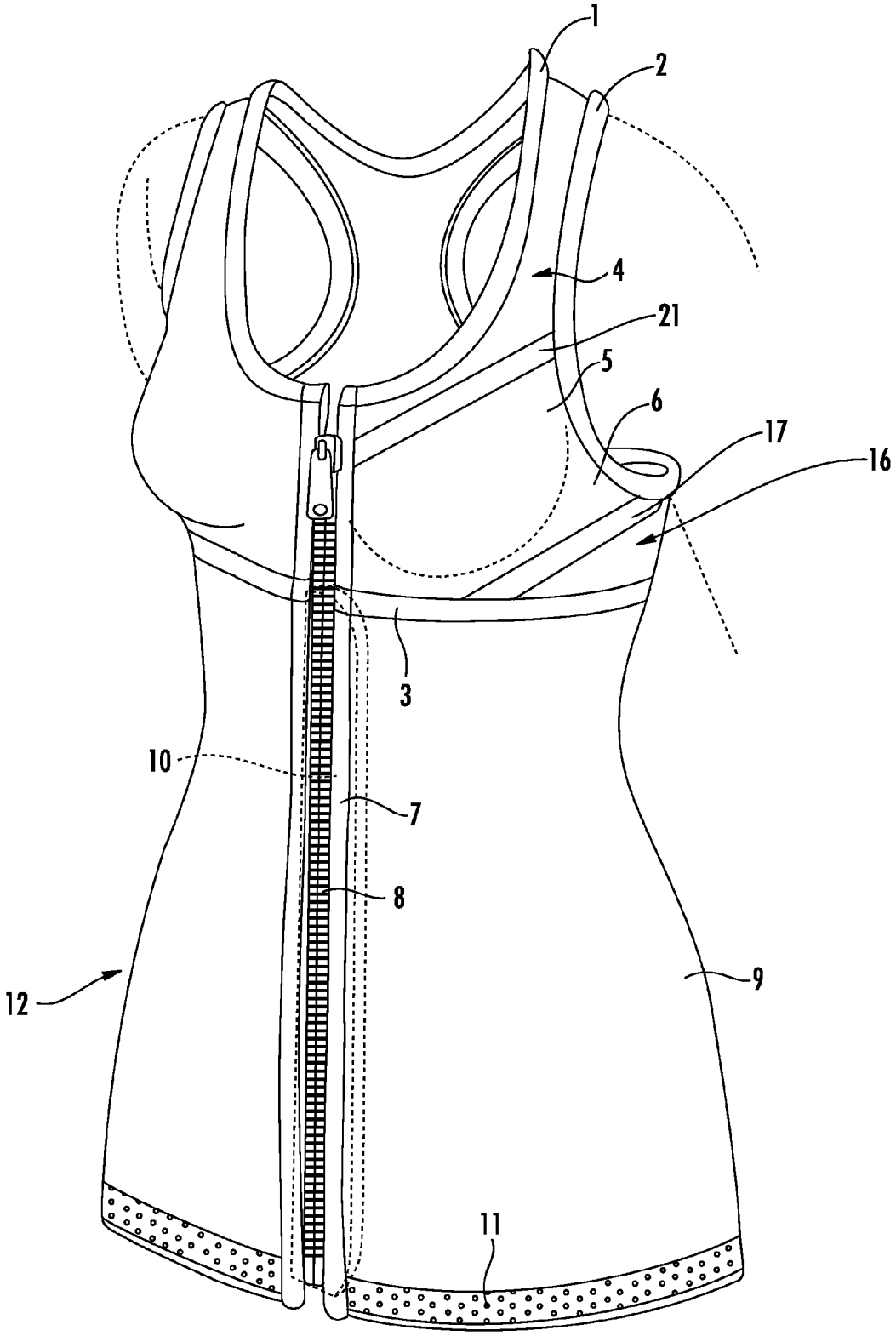
FIG. 2 is a perspective view of the garment of FIG. 1.
Figure 8:
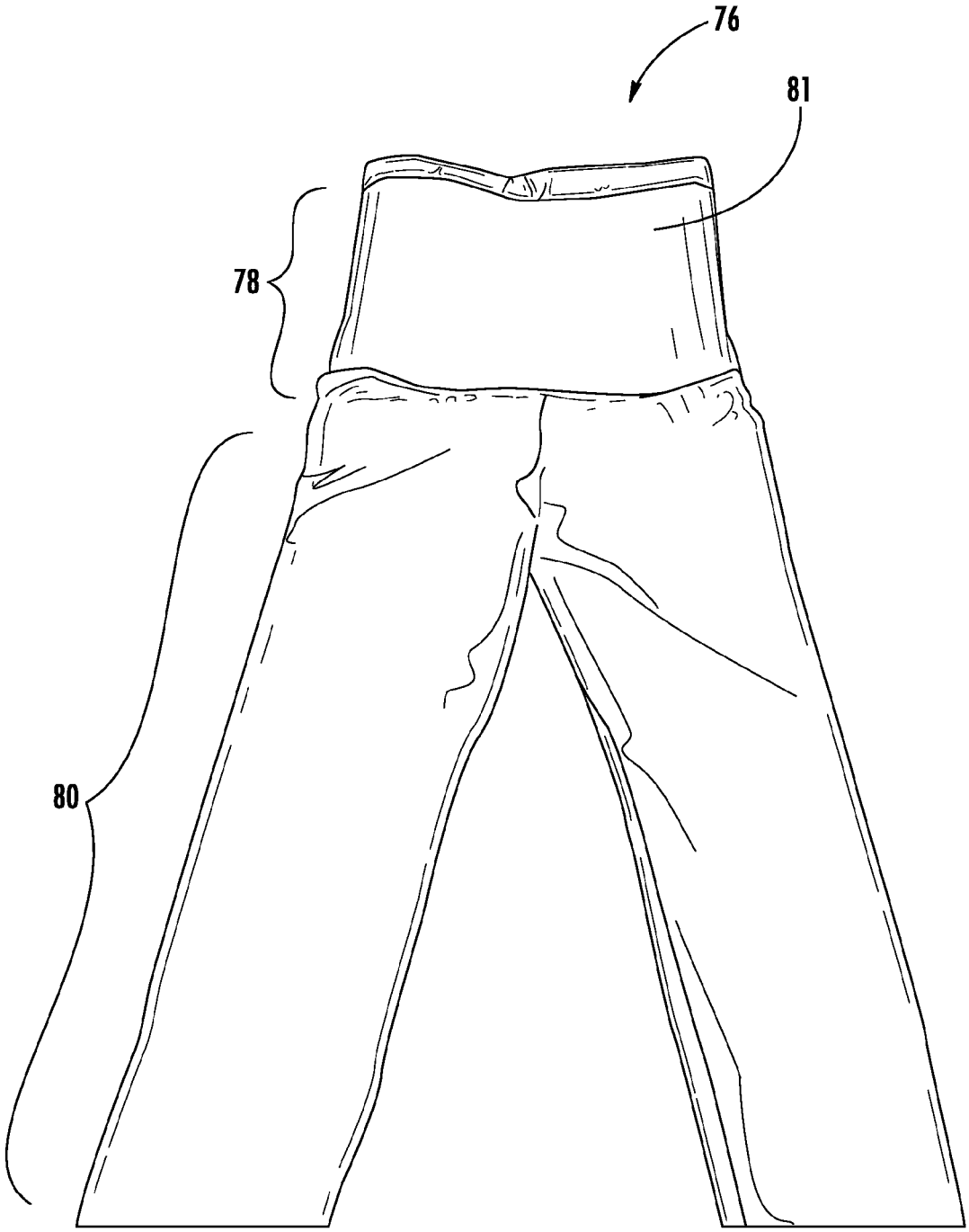
FIG. 8 is a front view of another garment embodiment in the reverse configuration.

Optionally, a moisture-absorbent material lining 11 on the sports bra portion or other areas of the garment may be included to absorb excess moisture and for increased comfort (FIG. 2). A pants portion in the form of shorts or longer leggings may also be made of a base fabric with a trunk portion and legs (FIG. 8). Each of the shirt portion and pants portion may include styled openings for receiving the arms and legs of the wearer. Accordingly, the invention allows the advantageous modality of donning and wearing a single integrated garment which provides support, comfort, freedom of motion to promote accelerated water weight loss.

The present invention provides an aerobic resistance garment, which may be used in warm weather or high temperature conditions, comprising a shirt portion 16 having a body portion and arms, said shirt portion being in the form of a sports bra made of open mesh/net base fabric material, a pants portion in the form of shorts made of a base fabric with a trunk portion and legs (FIG. 9), each of said shirt portion and said pants portion including at least one elastic resistance band 17, 18, 19, and 21 requiring force to stretch said band and resist said band from returning to its unstretched condition (not shown), said sports bra portion being spaced from said trunk portion to provide a bare midriff when in use, wherein said shirt portion includes sleeves, said elastic resistance bands extending across said body portion and down said sleeves, and each of said sleeves having a compression anchoring cuff, and an end of said band being secured to said anchoring cuff.

In conjunction with the included drawings, this detailed description is intended to impart an understanding of the teachings herein and not to define their metes and bounds. One particular implementation illustrating aspects of the present teaching is presented in detail below. Some of the many possible variations and versions are also described. As used in this document, the terms of up, upward, down, and downward are in reference to a garment worn by a person standing upright.

One version of a garment consistent with the teachings herein and which has a sports bra with integral fitted sauna suit is seen in FIG. 1. Referring back to FIG. 1, secured to the sports bra 4, is a fitted sauna suit 12 consisting of a base skirt 9 with adjoining strip 3 securing the sports bra 4 and the fitted sauna 12. Zipper 8 provides an ingress and securement means for donning the garment Inner elastic 1 and outer elastic 2 provide support for the breasts and finish the edges of neck opening 13 and arm opening 14 to present a smooth, comfortable, chafe resistant finish.

In the preferred embodiment of the present invention, a water resistant material 9 with elastic properties such as neoprene is used to form the major components of sports bra 4 and base skirt 9. The frontal elastic 7 combines the zipper 8 with the base skirt 9 and also used for comfort. The base skirt 9 is cut in a manner to reflect a corset shape of the torso area.

Referring now to FIG. 2, secured to the sports bra 4 is a fitted sauna suit 12 that includes a base skirt 9 with adjoining strip 3 securing the sports bra 4 and the fitted sauna suit 12. Under the sports bra 4 is second layer of fitted material 6, such as the clothing material sold under the trademark LYCRA®, is used for extra support of the breasts and to create a moderate lift and extra security. A water resistant material with elastic properties such a neoprene is used to keep the function of promoting water weight loss through sweat. A neoprene flap 10 serves as a zipper shield and is adapted to keep the zipper 8 from touching the skin while zipping up or down and when worn. The water resistant material 9 with elastic properties such a neoprene is also used for comfort. An absorbent lining on the lower extremity of the garment 11 is an optional feature that is used to absorb the sweat, that will be caused from the fitted sauna suit 12. The absorbent lining 11 on the lower extremity of the garment, is also used for comfort.

Figure 3:
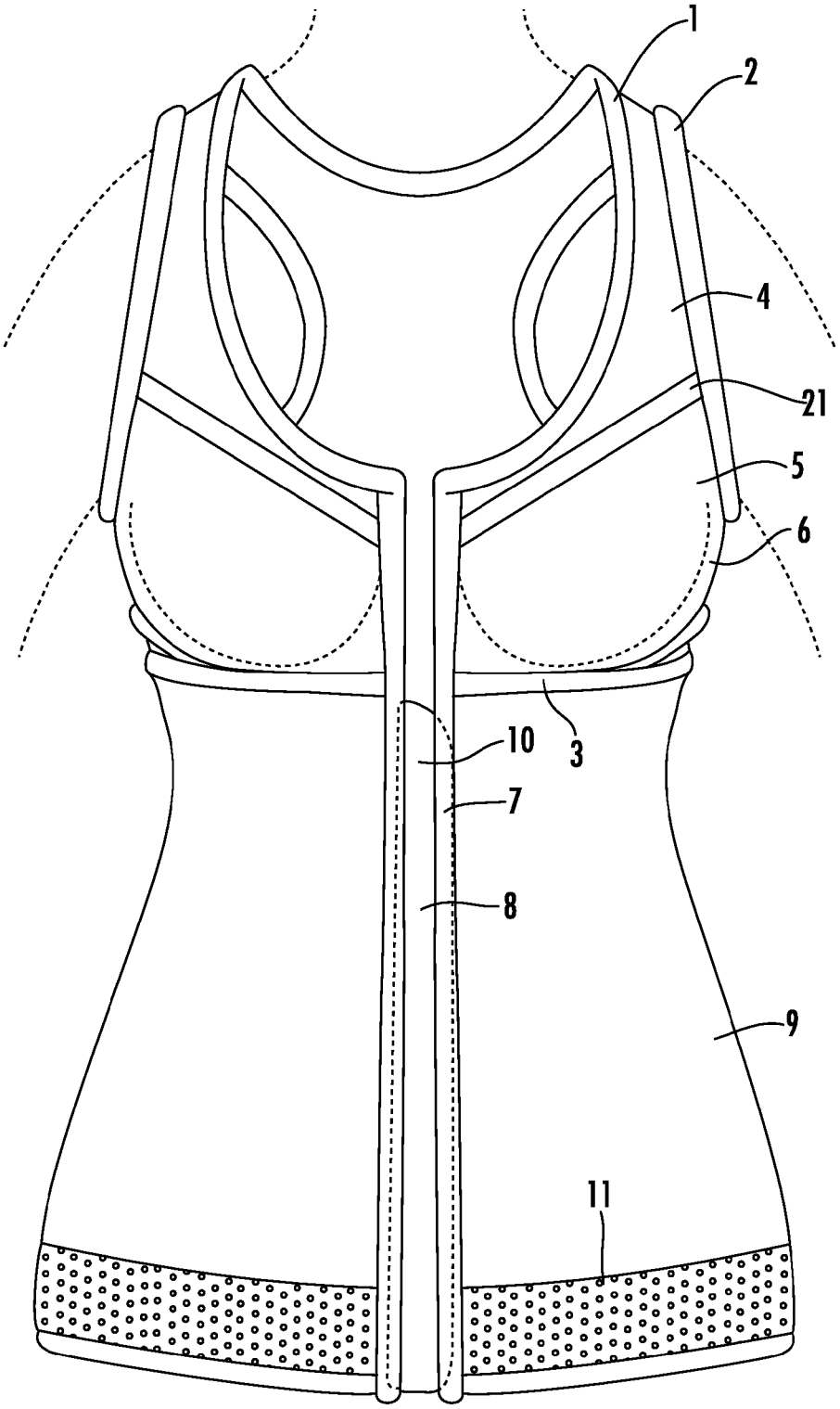
FIG. 3 is a front view of the garment of FIG. 1 in the reverse configuration illustrating zipper shield.
Figure 4:
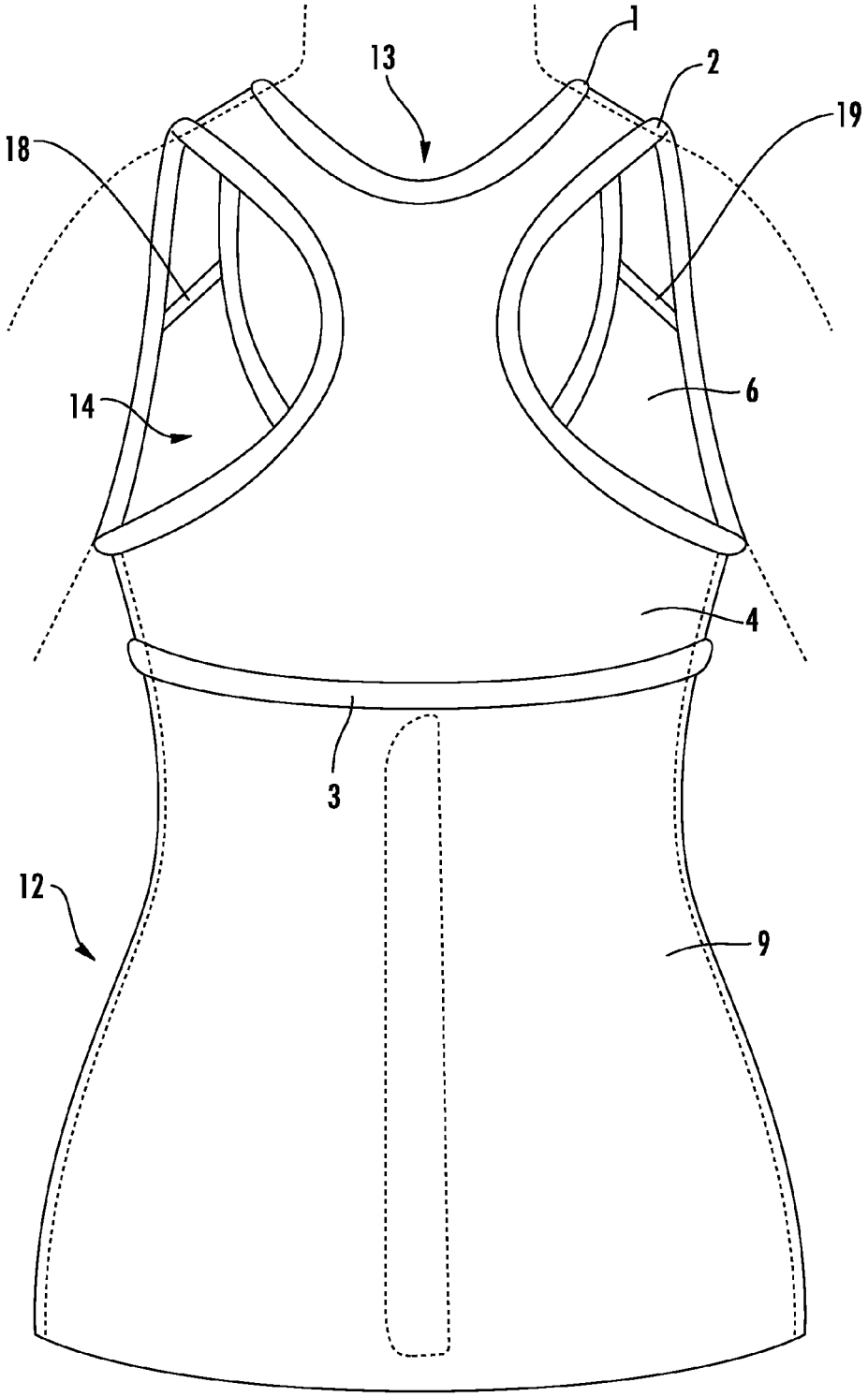
FIG. 4 is a rear view of the garment of FIG. 1.

Referring now to FIG. 3, secured to the sports bra 4 is a fitted sauna suit 12 consisting of a base skirt 9 with adjoining strip 3 securing the sports bra 4 and the fitted sauna suit 12. Between the sports bra 4 and the second layer of fitted material, such as the clothing material sold under the trademark LYCRA® 6, are the firm, dependable breast cups 5. The firm, dependable breast cups 5 are used for extra hold and to keep the shape of the breasts.

A. Moisture-Wicking Fabrics

The clothing articles may be formed using any suitable moisture-wicking material. Moisture-wicking fabrics refer to any fabric made from a fiber that does not absorb moisture into the fiber, rather the moisture remains on the surface of the fiber and thereby promotes rapid evaporation. Suitable fabrics include polyester, polyester based fabrics, nylon, polypropylene, polyurethane, and blends or combinations thereof. The fabrics may be formed of natural materials, such as cotton, wool, silk, and linen. Fabrics may include a mixture of natural and/or synthetic materials. Preferred fabrics include polyester and blends thereof, such as nylon-Spandex. A number of moisture-wicking fabrics have been designed and are commercially available, such as the polyester-based fabric, COOLMAX®, Extreme by Invista, DRI-RELEASE®, fabric by Optimer, Inc. (e.g. 88% Polyester/9% Cotton/3% Spandex; or 85% Polyester, 15% Cotton), NANO-TEX® Coolest Comfort fabrics by Nano-Tex, Inc. (may be used with a variety of fabrics, including 100% cotton), and CLIMAGUARD®, a TEFLON®-impregnated fabric developed by ROTOFIL®.

The clothing articles contain one or more areas for placing a water-absorbent material, such as pockets, pouches, folds (e.g., a fold in the fabric, creating a pouch), inserts in the lining. The area for placing the water absorbent material may contain an open portion, such as on a top portion of the area. The open area may be closed using one or more fasteners. Any conventional fastener may be used, including but not limited to, snaps, clips, zippers, the strings, buttons, hooks and eyes, and hook and -loop materials, typically available under the VELCRO® trademark. The fastener is used to close or seal the area and keep the water-absorbent material inside the area, even during vigorous exercise.

III. Water-Absorbent Materials

The water-absorbent material absorbs at least approximately 10 times in weight in water, or aqueous solutions. In preferred embodiment, the water-absorbent material absorbs at least approximately 12 times in weight (dry) in water or aqueous solutions. Preferably the material absorbs up to 12 times its weight in water or aqueous solutions without feeling wet to a user. The water absorbent materials do not dissolve in water at standard temperatures and pressures. The water-absorbent material is typically in the form of a towel, pad or strip of material. Any suitable thickness may be used, preferably the water-absorbent material does not significantly increase the thickness of the overall clothing articles when placed in the pouch, fold or pocket. Thinner water-absorbent materials are generally preferred. Typical thicknesses range from up to 1 cm to up to 4 cm. In one preferred embodiment, the water-absorbent material typically has a thickness ranging from 2 cm to 4 cm. When worn by an individual, the clothing articles are particularly useful at preventing perspiration from running down a user's face, hands, back, or body.

The present invention relates to manufacturing techniques for incorporating elastic resistance bands into aerobic resistance garments. Reference is made to U.S. Pat. Nos. 5,109,546, 5,176,600, 5,186,701, 5,201,074, 5,306,222 and 5,570,472 and 5,570,472, and to U.S. patent applications, Ser. No. 627,426 filed Apr. 4, 1996; Ser. No. 660,098, filed Jun. 6, 1996; Ser. No. 734,736, filed Oct. 21, 1996; Ser. No. 761,290, filed Dec. 6, 1996; Ser. No. 777,453, filed Dec. 3, 1996; Ser. No. 802,972, filed Feb. 20, 1997; Ser. No. 802,973, filed Feb. 20, 1997; Ser. No. 834,887, filed Apr. 7, 1997; Ser. No. 840,917, filed Apr. 25, 1997; Ser. No. 880,715, filed Jun. 23, 1997; Ser. No. 892,669, filed Jul. 14, 1997, and Ser. No. 986,521, filed Dec. 8, 1997, all of the details of which are incorporated herein with reference thereto. Such patents and applications exemplify the general types of garments to which the manufacturing techniques may be applied for making garments in accordance with this invention. Other more specific forms will be described in detail hereafter.

In general, the aerobic resistance garment may be made from two different types of materials having different elastic characteristics. One of the materials, which functions as the elastic resistance elements or bands, preferably has a resistance force that can be overcome by the user while wearing the garment. The other material preferably has some degree of elasticity and may be made of the types of materials noted in the aforementioned patents. The base material for the garment may be selected so as to provide comfort to the user. Such material could be a stretch material having four-way or two-way stretch, preferably using a LYCRA® spandex yarn. Other examples are DuPont's TACTEL® and SUPPLEX® textiles. The elastic resistance material may stretch in at least one direction and may require force by the user to stretch thereby enhancing the aerobic quality of the material. Reference is being made to the aforenoted patents for use as examples of such materials for elastic resistance bands. A suitable material is a raschel knit containing LYCRA® spandex. The garment may comprise moisture absorbent materials at pre-selected locations, for instance in the under cups of the sports bra. The garment having such materials may be formed from one or more moisture wicking fabrics and may include a water-absorbent material polyvinyl alcohol material surrounded by the moisture-wicking fabric. A preferred water-absorbent material may be polyvinyl alcohol towel or chamois. In one embodiment, the water-absorbent material is enclosed in a pouch or pocket in the fabric, preferably the pouch or pocket is positioned to contact a surface of a user's body. In another embodiment, the water-absorbent material can be placed into a fold in the fabric or a liner within the clothing article.

The garment preferably includes at pre-selected locations the elastic resistance bands 17, 18, 19 and 21. Generally, such bands have anchor structure in order to function as an aerobic garment. For example, where used in the shirt portion of the garment the anchor structure might be at the ends of the arms, such as at the hands or wrists. Where used in the pants portion of the garment the anchor structure might be at the legs or feet and might also be at the shoulders. Others locations of anchor structure might also be used with the practice of this invention. For example, a pants portion may terminate at the waist and anchor structure could be provided at the waist. A pants portion might also terminate in the general area of the knees and the anchor structure could be provided at, above or below the knees. With regard to the shirt portion the elastic band could extend from arm to arm with the anchor structure at each arm. Alternatively, the elastic band could extend from one arm to a further portion of the garment such as on the torso, neck or shoulder area and be provided with anchor structure at that area.

In general, the aerobic garment may be made by first designing the garment and determining the body dimensions. Next, the fabric may be selected and patterns may be made. Preferably the first sample may be cut and sewn and then fitted. After this testing any errors in the patterns may be corrected. A second sample would then be cut, sewn and fitted and corrections made for fit, function and patterns. The patterns may be grade and markers made. Specification sheets would be set up and sewing sheets would be created. Cutting tickets may be written and the final garments may be cut and sewn.

In general, the basic fabric may have its section sewn together to form a base unit. The elastic aerobic bands 17, 18, 19 and 21 may then be incorporated into the basic garment by being sewn at the appropriate locations to form a final garment section. A feature of the invention is that the elastic bands 17, 18, 19 and 21 are designed so as to minimize the number of pieces required and to avoid seams across the direction of stretch which would otherwise interfere with the performance of the elastic resistance bands 17, 18, 19 and 21. A characteristic of such elastic resistance bands 17, 18, 19 and 21 may be the high modulus required to return the bands when stretched. Thus, a physical exertion may be required to stretch the bands and the muscles work to hold or restrain the bands 17, 18, 19 and 21 when the bands 17, 18, 19 and 21 attempt to return to their original unstretched size.

Variations

There are many possible variations of the version described above. One variation is a suit which encloses the entire body including long sleeves and full pant legs (FIGS. 5*a-c* and 6). A second variation is a suit which covers only the abdomen. Variations in length of the sweat skirt may accommodate a wide range of requirements and applications. In broad embodiment, the present invention is a sauna suit with integrated sports bra and integrated sweat absorbing panel which may afford the user a supportive, aesthetically flattering, and highly functional water weight loss promoting garment. Examples of implementations consistent with this invention include sports bras with a torso length sauna suit (FIGS. 7*a-c* and FIGS. 12*a-b*), a 'jacket' style garment with integral sports bra and long sleeves (FIGS. 5*a-c*, 6, and 13*a-b*), and a sports bra or jacket style garment with a sauna suit which extends over the thighs, or integrates shorts (FIG. 11*a-c*) or full length pants (FIGS. 5*a-c* or 6 combined with FIG. 8, FIGS. 9*a-b*, FIGS. 10*a-c*).

Figure 5A:
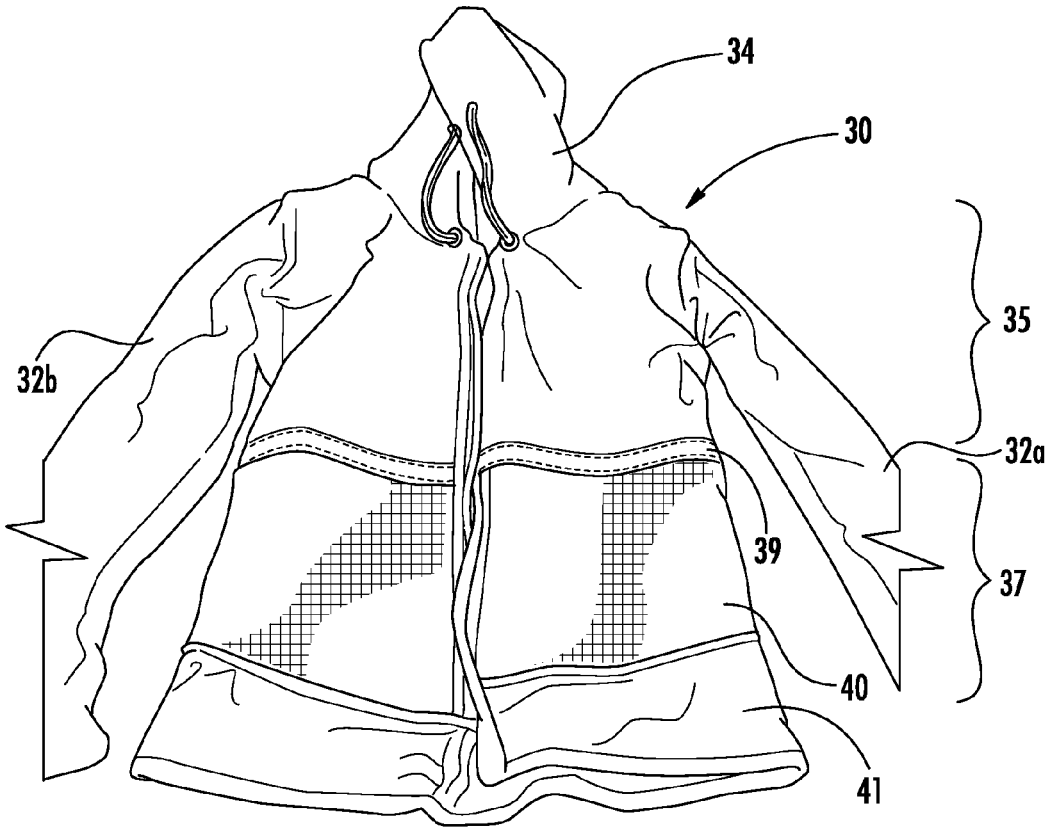
FIG. 5*a* is a front view of another garment embodiment.

Referring now to FIG. 5*a*, a clothing is provided that includes a sweater 30 with long sleeves 32*a* and 32*b* configured to cover a user's arms and a hood 34 configured to cover a user's head. For ease of description, the sweater 30 may be divided into several sections: a breast section 35 configured to cover the user's breast and a midsection 37 configured to cover the user's abdomen. The long sleeves 32*a* and 32*b*, the hood 34, and the breast section 35 may be made of the same material, such as synthetic blend, cotton, or other materials known in the art. The long sleeves 32*a* and 32*b* may include an interior portion configured to directly contact the underarms made of a perspiration promoting material as further described below.

An elastic material 39 configured to support the breast, as described below, is preferably attached in between the breast section 35 and the midsection 37. The midsection 37 preferably includes a secondary material 40 covering a perspiration promoting material as further described below. The secondary material 40 may be made of nylon. As shown in FIG. 5*a*, the breast section 35 may be made of a material that is different from the secondary material; the midsection 37 may be partially covered by the secondary material 40; and, a portion 41 of the midsection may be made of the same material as the breast section 35. In other embodiments, the midsection 37 may be entirely covered by the secondary material 40, or it may be entirely covered by the same material as the breast section 35 (not shown).

Figure 5B:
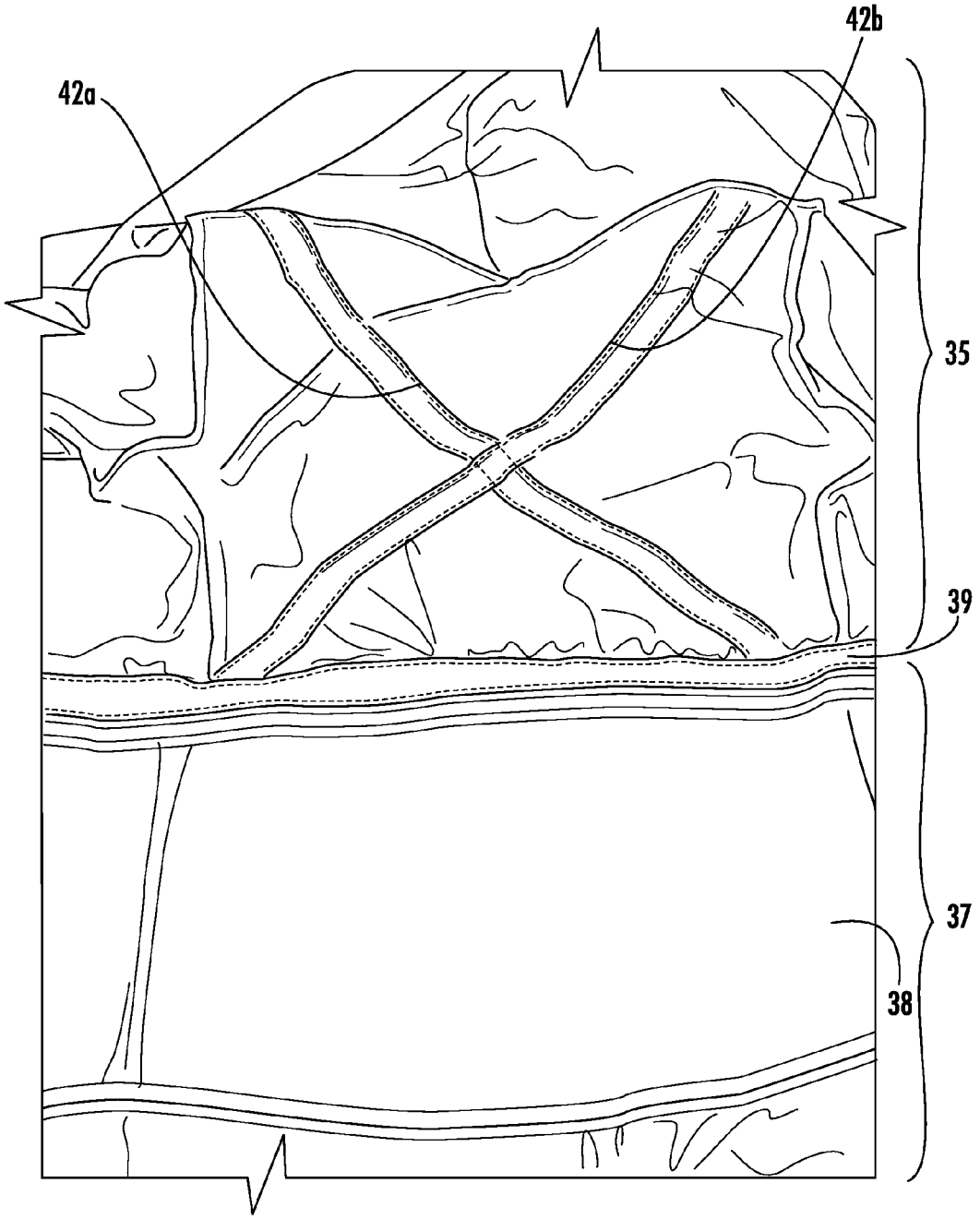
FIG. 5*b* is a partial view of the interior of the garment embodiment of FIG. 5*a*, specifically its portion configured to cover a user's back.

Referring now to FIG. 5*b*, the interior side of the sweater 30 configured to directly contact the user's body preferably includes a perspiration promoting material 38 positioned on the midsection 37. The perspiration promoting material 38 is preferably a water resistant material, such as neoprene. The perspiration promoting material 38 preferably surrounds the midsection of the sweater 30 and is configured to directly contact and cause the user's abdomen area and lower back to sweat or perspire. The interior side of the sweater 30 that is configured to directly contact the user's back preferably includes a pair of elastic bands 42*a* and 42*b* that may be criss-crossed and may be embedded within the clothing. The elastic bands 42*a* and 42*b* are preferably connected to the elastic bands positioned around the bra cups described below and are configured to provide lift and support to the user's breasts. The elastic bands 42*a* and 42*b* preferably connect to the elastic material 39 positioned in between the breast area 35 and the midsection area 37. The elastic material 39 is preferably configured to provide additional lift and support to the user's breasts.

Figure 5C:
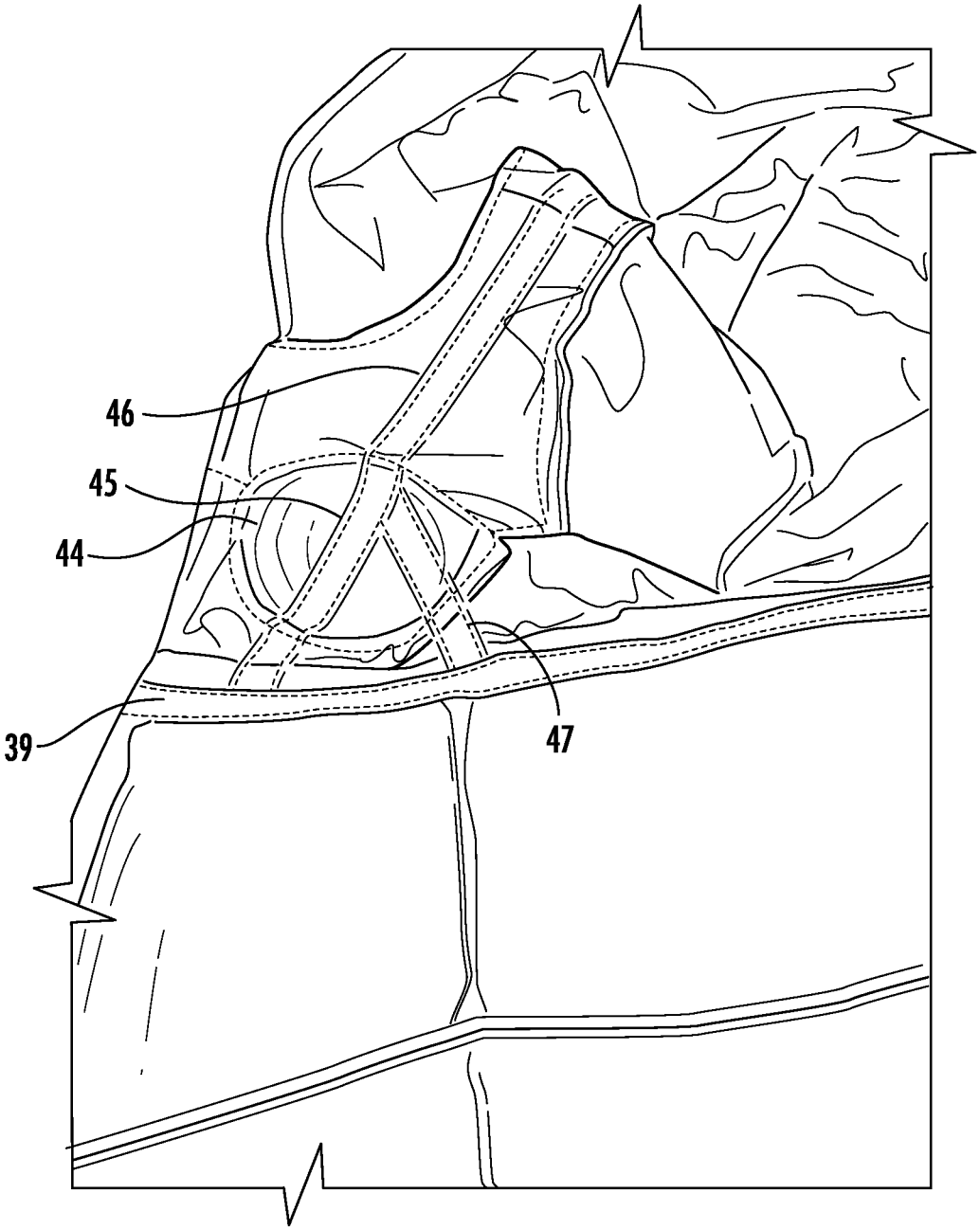
FIG. 5*c* is a partial view of the interior of the garment embodiment of FIG. 5*a*, specifically its portion configured to cover a portion of the user's front body.

Referring now to FIG. 5*c*, the interior side of the sweater 30 preferably includes a pair of bra cups 44. The bra cups 44 are preferably configured to support the user's breasts. To further support the user's breasts and provide lift, a plurality of elastic bands is preferably provided. For each side of the breast, an elastic band 46 is preferably positioned at the top of the bra cup 44 and connected to elastic band 42*a* or 42*b*. Elastic band 45 preferably crosses the bra cup 44 and is attached in between elastic band 46 and elastic band 39. Elastic band 47 is preferably attached at an angle to elastic band 45 and elastic band 39. Elastic band 47 may also cross bra cup 44 and may form an anchor for the breast configured to be positioned in the bra cup 44.

The bra cups 44 and the elastic bands 42*a*, 42*b*, 39, 45, 46, and 47 are preferably embedded into the clothing. For example, they may be covered and sown in between the material for the front breast section and a similar material for the interior breast section so as not to directly contact the user's skin and cause any irritation. They may be made of substantially waterproof materials, and they may be embedded by sewing. They may also be embedded into the clothing by providing slots within the clothing (not shown) that may allow the bra cups and elastic bands to be attached to or detached from the clothing. The elastic bands 45, 46, and 47 may be positioned above, below, across, or on the side of the bra cup 44.

Figure 6:
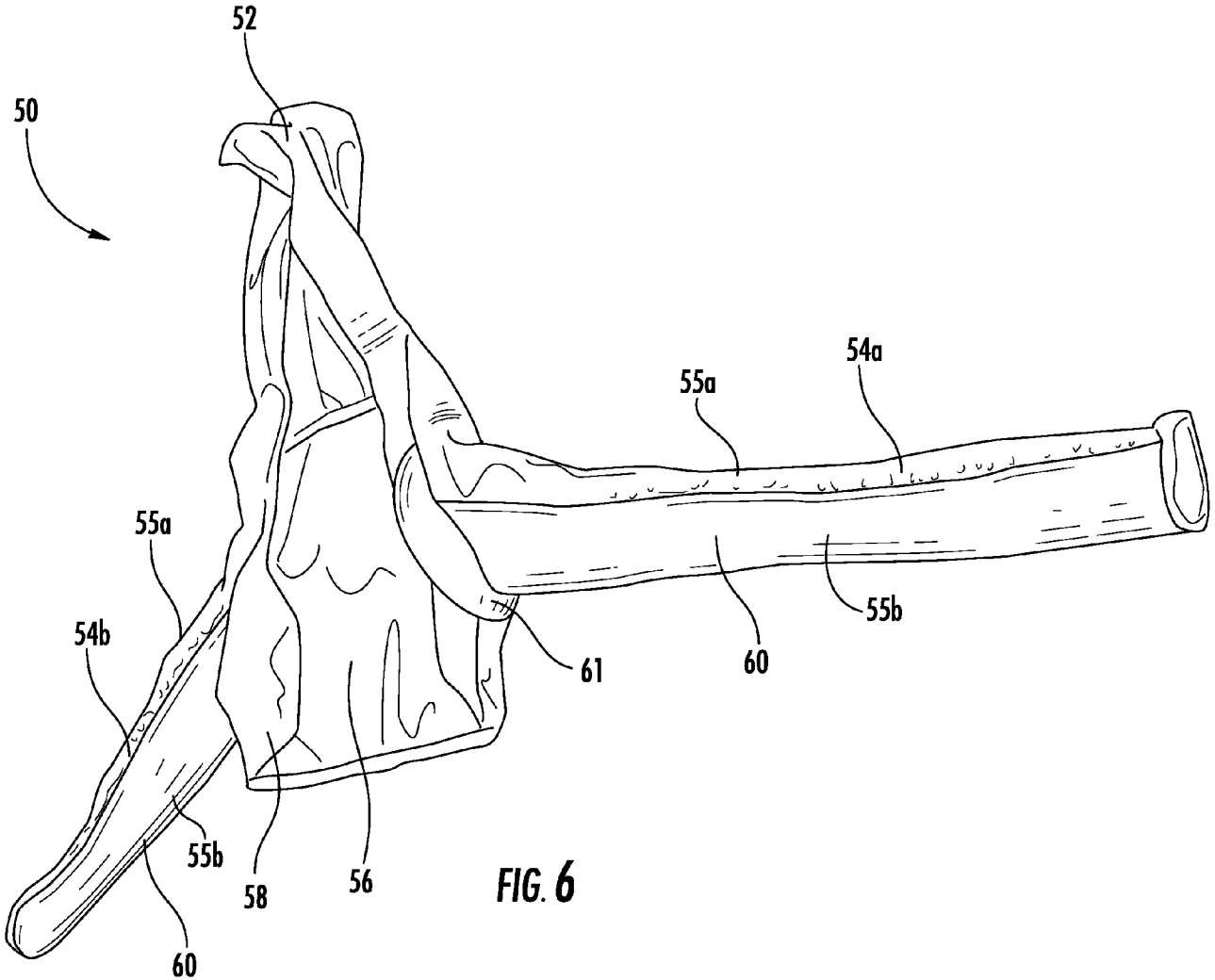
FIG. 6 is a perspective view of another garment embodiment in the reverse configuration.

Referring now to FIG. 6, a crop jacket clothing embodiment 50 is provided that may be similar to clothing embodiment 30 except that the front side of the clothing configured to cover the user's breast and abdomen is removed, and it may be a midriff cut. The crop jacket clothing embodiment 50 is shown in FIG. 6 in its reverse configuration to show its internal components. Clothing embodiment 50 preferably includes a hood 52 configured to cover a user's head, a pair of long sleeves 54*a* and 54*b* configured to cover a user's arms, and a back portion 56 configured to cover a user's back. The clothing embodiment 50 may include a partial front cover 58.

The long sleeves 54*a* and 54*b* preferably includes an exterior portion that does not directly contact the user's arms and that is made of nylon or the same material as the hood 52. The long sleeves 54*a* and 54*b* preferably also includes an interior portion that directly contacts the user's arms and that is made of, at least partially, a perspiration promoting material 60, such as a water resistant material or neoprene. The perspiration promoting material 60 may be positioned on the bottom half of each sleeve and thus may divide each sleeve such that it includes a top section 55*a* and a bottom section 55*b*. The perspiration promoting material 60 is preferably positioned to contact the underarms of the user to cause them to sweat and tone the underarms of the user, which is a common location of excess fat or water. The exterior portion of the long sleeves 54*a* and 54*b* is preferably designed such that it discreetly covers the perspiration promoting material 60 by blending with the predominant color or predominant material of the clothing exterior. This may also be true for the midsection portion 37 of the sweater embodiment 30. Another perspiration promoting material 61 may be positioned around the point of attachment of each sleeve to the rest of the clothing embodiment 50. Perspiration promoting material 61 is preferably configured to surround a portion of the user's breast, side, back, and shoulder and promote perspiration at these areas.

Figure 7A:
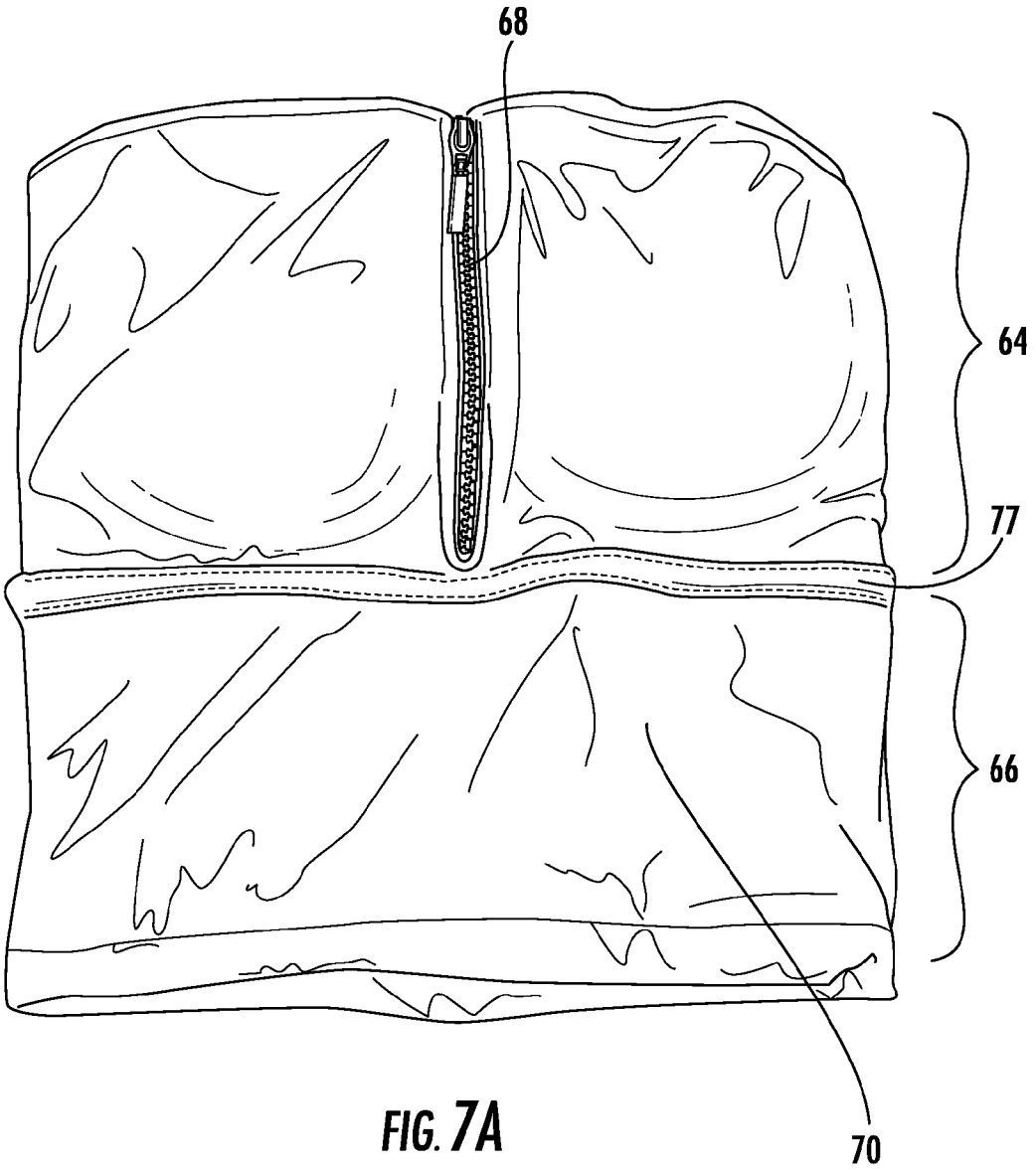
FIG. 7*a* is a front view of another garment embodiment.

Referring now to FIG. 7*a*, a torso length or tube top clothing embodiment 62 is shown. The tube top clothing embodiment 62 is preferably configured to substantially cover the breasts, the abdomen, and a back portion of the user. The user's shoulders, arms, and upper back portion may be left uncovered. The tube top clothing embodiment 62 preferably includes a breast portion 64, a midsection portion 66, and an elastic 77 positioned preferably in between the breast portion 64 and the midsection portion 66. The elastic 77 is preferably made of and serves the same function as the previously described elastic 39. The breast portion 64 may include a slit 68 configured to be positioned substantially in the middle and may be lined by a zipper configured to allow the user to open or close the slit 68. The midsection portion 66 preferably includes a perspiration promoting material as previously discussed and positioned to be inside the clothing and to directly contact the user's abdomen and back. Opposite the perspiration promoting material is preferably a disguise material 70 configured to discreetly hide the perspiration promoting material. The disguise material 70 may be the same material as the material for the breast portion 64, or it may be made of nylon.

Figure 7B:
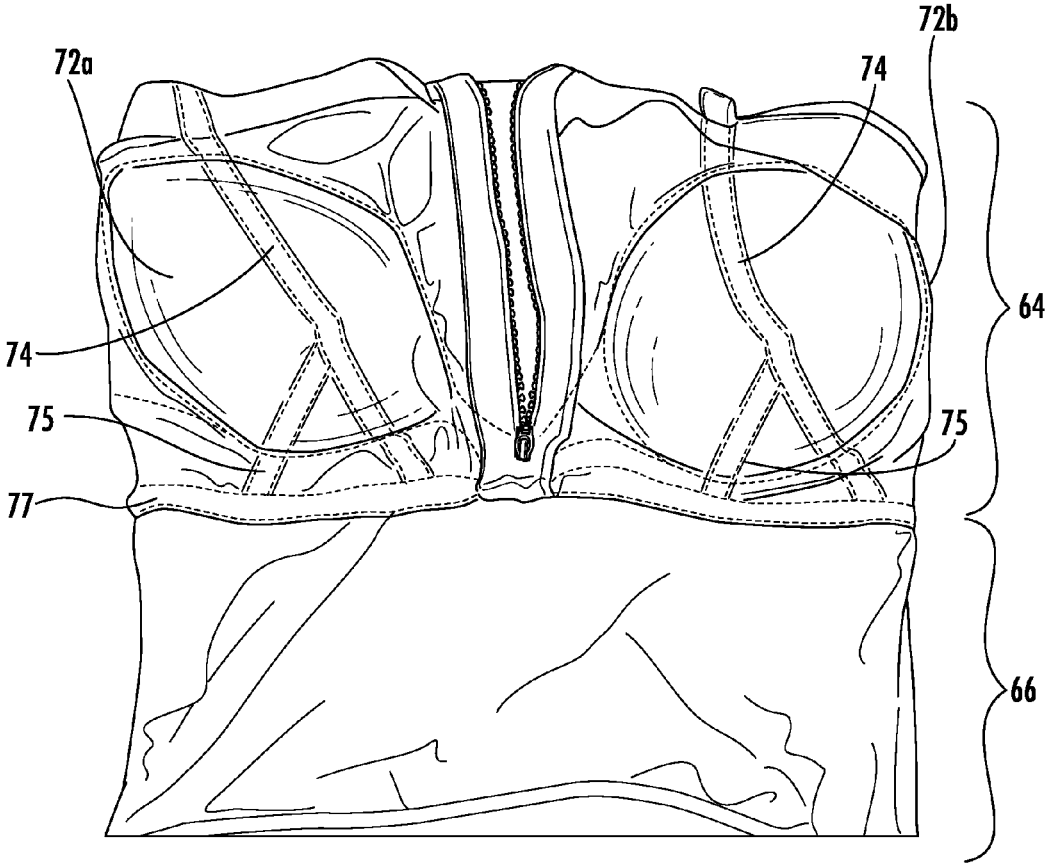
FIG. 7*b* is a view of the front portion of the garment embodiment of FIG. 6*a* in the reverse configuration.
Figure 7C:
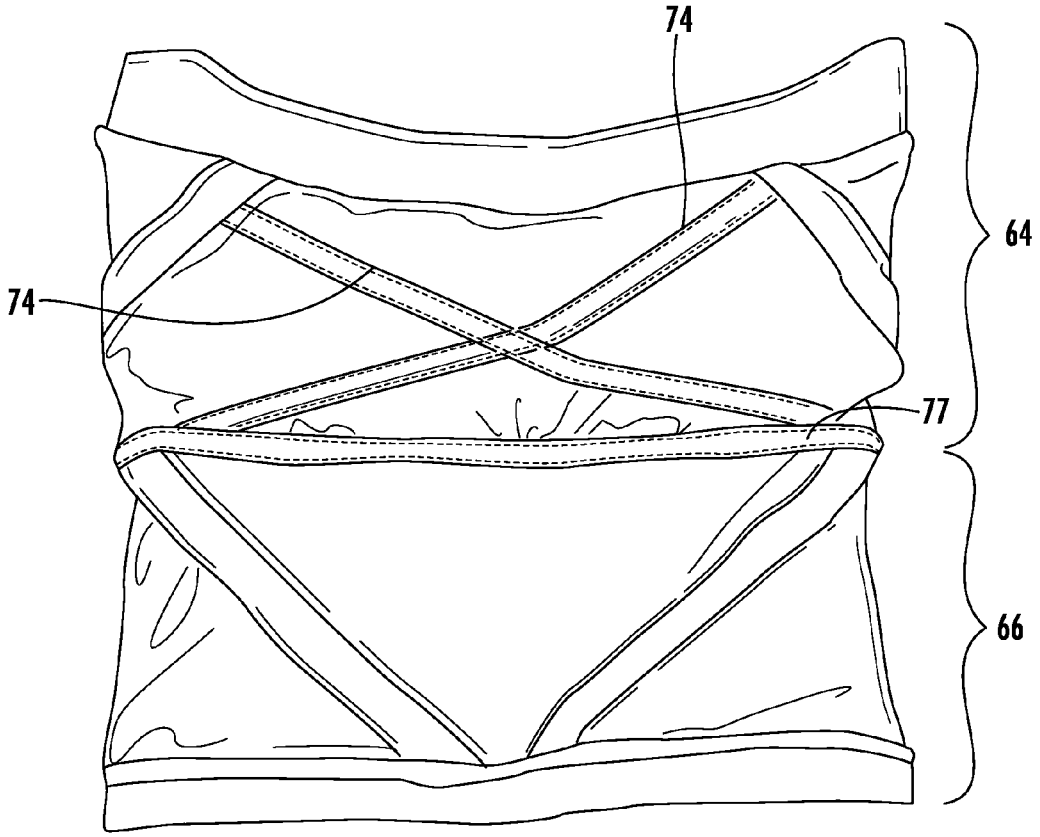
FIG. 7*c* is a view of the back portion of the garment embodiment of FIG. 6*a* in the reverse configuration.

Referring now to FIG. 7*b*, the side of the breast portion 64 that is configured to form the interior of the clothing preferably includes a pair of bra cups 72*a* and 72*b*. The pair of bra cups 72*a* and 72*b* is preferably configured to support and provide lift to the user's breasts together with their respective elastic bands 74, 75, and 77. Elastic band 77 preferably provides a base and is configured to surround a user's body. Elastic bands 74 are preferably attached to elastic band 77, cross their respective bra cup, and preferably extend all the way to the back portion of the clothing where they may cross (as shown in FIG. 7*c*). Elastic bands 75 are preferably also attached to elastic band 77, partially cross their respective bra cup, and attach to elastic band 74. The bra cups and elastic bands are preferably embedded into the clothing. Slots that house them or allow them to be attached and detached from the clothing may be provided (not shown). In other embodiments (not shown), the elastic bands may be positioned on the top, the bottom, or the side of the bra cup.

Referring now to FIG. 8, a pair of pants 76 that may be worn with the clothing embodiments above or by itself is shown in its reverse configuration to show its internal components. Pants 76 preferably includes a waist portion 78 configured to cover a user's waist area and leg portion 80 configured to cover a user's body from the waist down. The waist portion 78 may be extended such that it covers at least some of or the user's entire lower abdomen. The waist portion 78 preferably includes an internal perspiration promoting material 81 such as described above and is configured to contact the user's skin and promote perspiration around the lower abdominal area, the hips, or the waist of the user. Opposite the internal perspiration promoting material 81 is preferably a disguise material such as described above configured to discreetly hide the perspiration promoting material. The disguise material is preferably made of nylon or material similar to the leg portion 80.

Figures 9A, 9B:
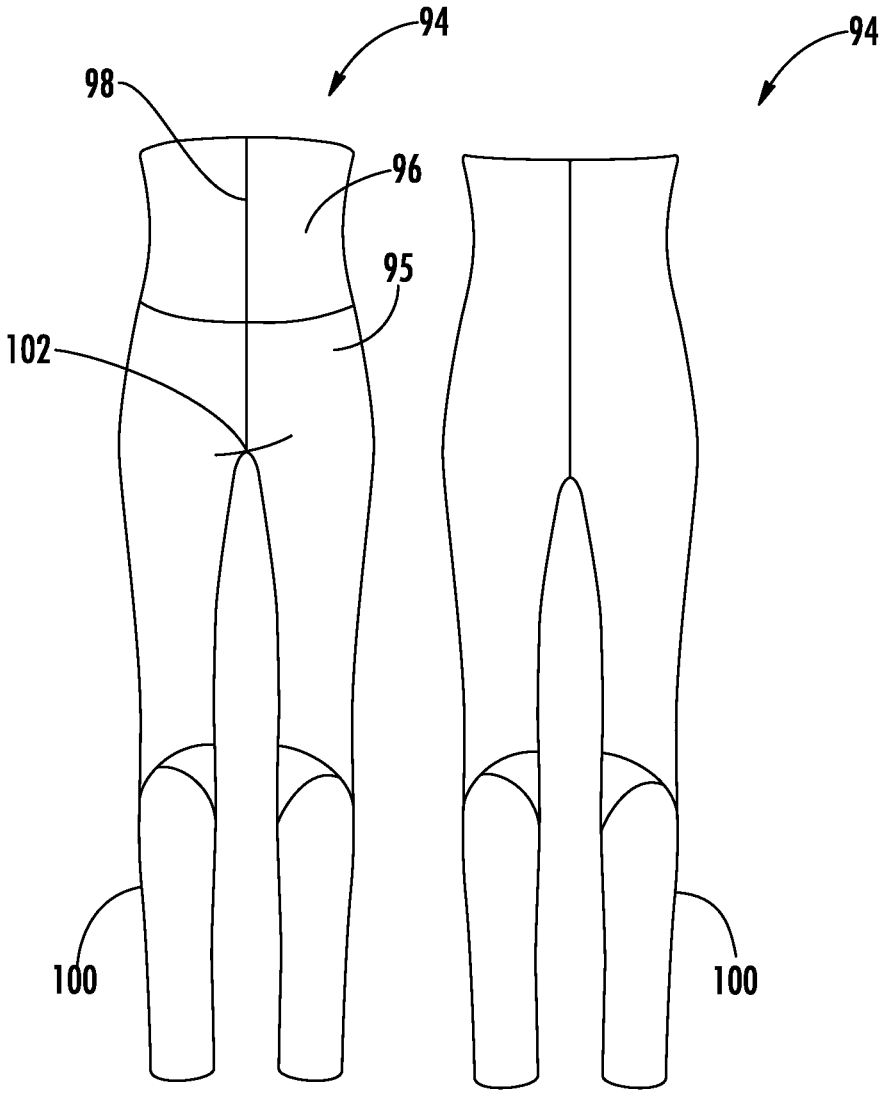
FIG. 9*a* is a front view of another garment embodiment in the reverse configuration.
FIG. 9*b* is a rear view of the garment embodiment of FIG. 9*a* in the reverse configuration.
Figure 10A:
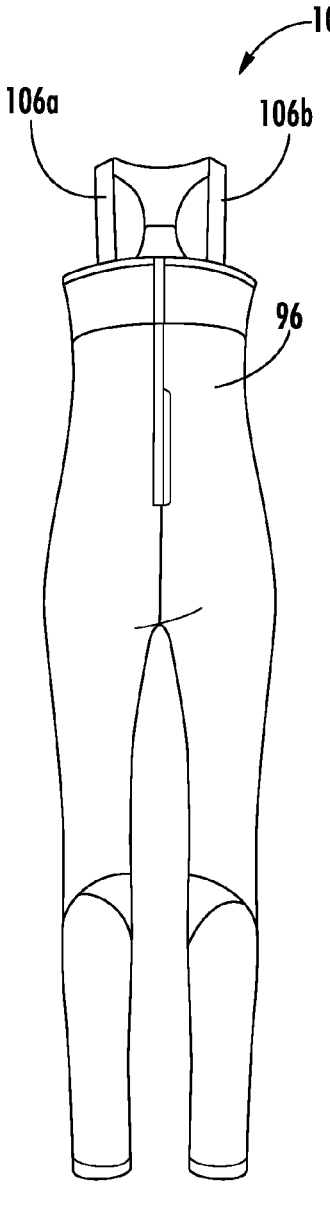
FIG. 10*a* is a front view of another garment embodiment in the reverse configuration.
Figure 10B:
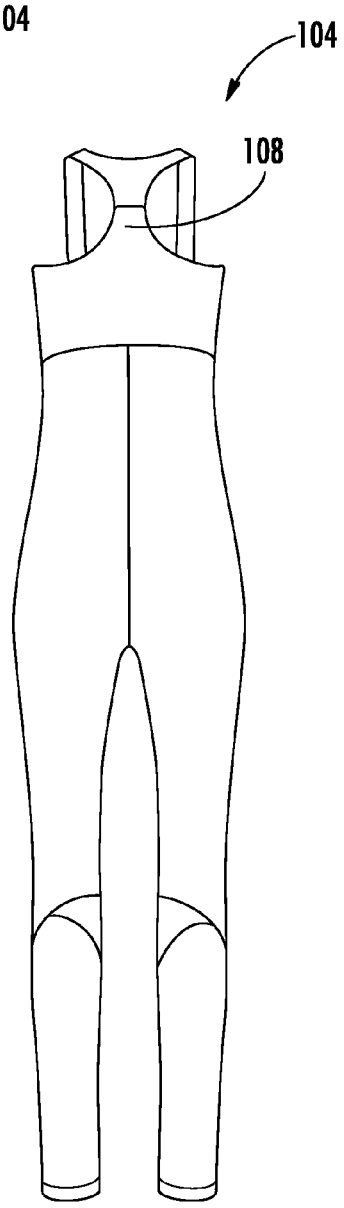
FIG. 10*b* is a rear view of the garment embodiment of FIG. 9*a* in the reverse configuration.
Figure 10C:
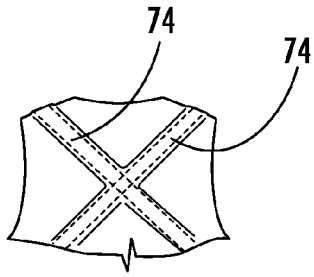
FIG. 10*c* is a view of the interior of the top front portion of the garment embodiment of FIG. 9*a*.
Figure 10D:
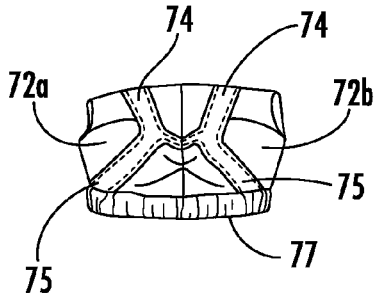
FIG. 10*d* is a view of the interior of the top rear portion of the garment embodiment of FIG. 9*a*.

Referring now to FIGS. 9*a* and 9*b*, another embodiment is shown that is similar to the pair of pants 76 except that a tube top portion 96 is added to its waist portion 95. The tube top portion 96 preferably includes a slit 98 configured to be positioned substantially in the middle and may be lined by a closure assembly configured to allow the user to open or close the slit 98. The closure assembly may be a zipper or the closure assembly described below and shown in FIG. 14. The other difference with pants 76 is that the perspiration promoting material is preferably configured to contact a user's body that spans from the lower abdomen to an area slightly past the user's knee. Yet another difference may be that a material different from the perspiration material, such as nylon or the disguise material described above, may be provided around the calf area 100 and the crotch area 102.

Referring now to FIGS. 10*a-d*, another garment embodiment 104 is shown, which is preferably similar to embodiment 94 except that a pair of shoulder straps 106*a* and 106*b* are added and attached to the tube top portion 96 and a back portion 108 connected to the shoulder straps is also added. The back portion 108 may include a pair of elastic straps 74 (FIG. 10*c*) configured to provide support and lift to the user's breasts and is preferably similar to elastic strap 74 previously described. The tube top portion 96 preferably includes a pair of bra cups 72*a* and 72*b* and elastic materials 74, 75, and 77, which were previously described from FIGS. 7*a*-7*c*. It is noted that the elastic material 77 may be shortened up to the point of attachment with elastic material 75.

Figure 11A:
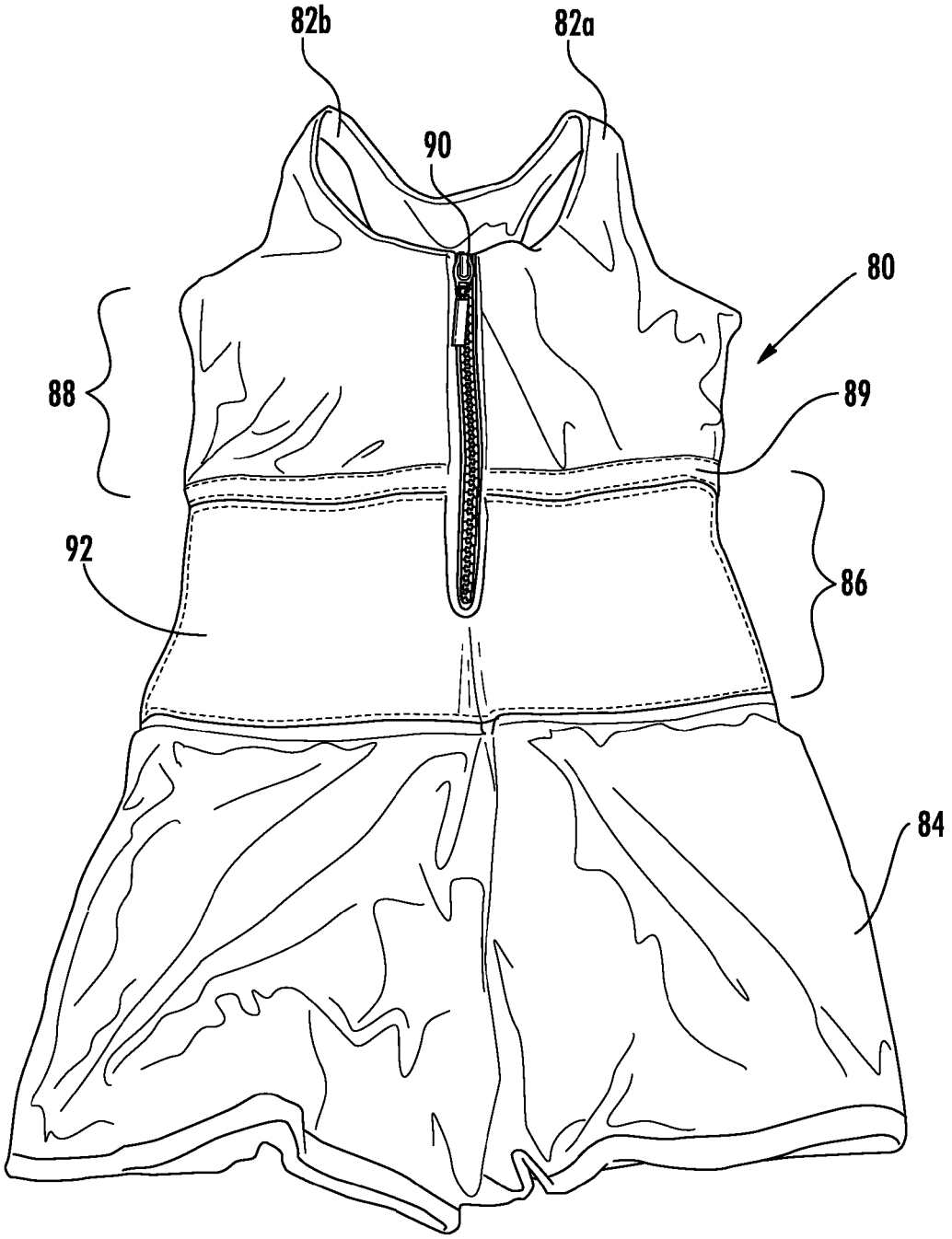
FIG. 11*a* is a front view of another garment embodiment.

Referring now to FIG. 11*a*, yet another clothing embodiment is shown. Jumpsuit embodiment 80 is preferably similar to the tube top clothing embodiment 62 and includes all the components of the tube top clothing embodiment 62. Jumpsuit embodiment 80 may differ from the tube top clothing embodiment 62 in that it includes a pair of shoulder straps 82*a* and 82*b* configured to allow the user's shoulders to support the clothing and a pair of short pants 84 connected to the midsection 86. Of course, the short pants can be replaced with a skirt or long pants. Its breast portion 88 may also include a slit 90 configured to be positioned substantially in the middle and may be lined by a closure assembly configured to allow the user to open or close the slit 90. The closure assembly may be a zipper or the closure assembly described below and shown in FIG. 14. An elastic material 89 similar to elastic material 39 and 77 described above is preferably positioned in between the breast portion 88 and midsection portion 86. The midsection portion 86 preferably includes a perspiration promoting material as previously discussed and positioned to be inside the clothing and to directly contact the user's abdomen and back. Opposite the perspiration promoting material is preferably a disguise material 92 configured to discreetly hide the perspiration promoting material. The disguise material 92 may be the same material as the material for the breast portion 88, or it may be made of nylon.

The side of the breast portion 88 that is configured to form the interior of the clothing preferably also includes a pair of bra cups 72*a* and 72*b*. The pair of bra cups 72*a* and 72*b* is preferably configured to support and provide lift to the user's breasts together with their respective elastic bands 74, 75, and 89. Elastic band 89 preferably provides a base and is configured to surround a user's body. Elastic bands 74 are preferably attached to elastic band 89, cross their respective bra cup, and preferably extend all the way to the back portion of the clothing where they may cross (as shown in FIG. 11*c*). Elastic bands 75 are preferably also attached to elastic band 89, partially cross their respective bra cup, and attach to elastic band 74. The bra cups and elastic bands are preferably embedded into the clothing. Slots that house them or allow them to be attached and detached from the clothing may be provided (not shown). In other embodiments (not shown), the elastic bands may be positioned on the top, the bottom, or the side of the bra cup.

Figure 11B:
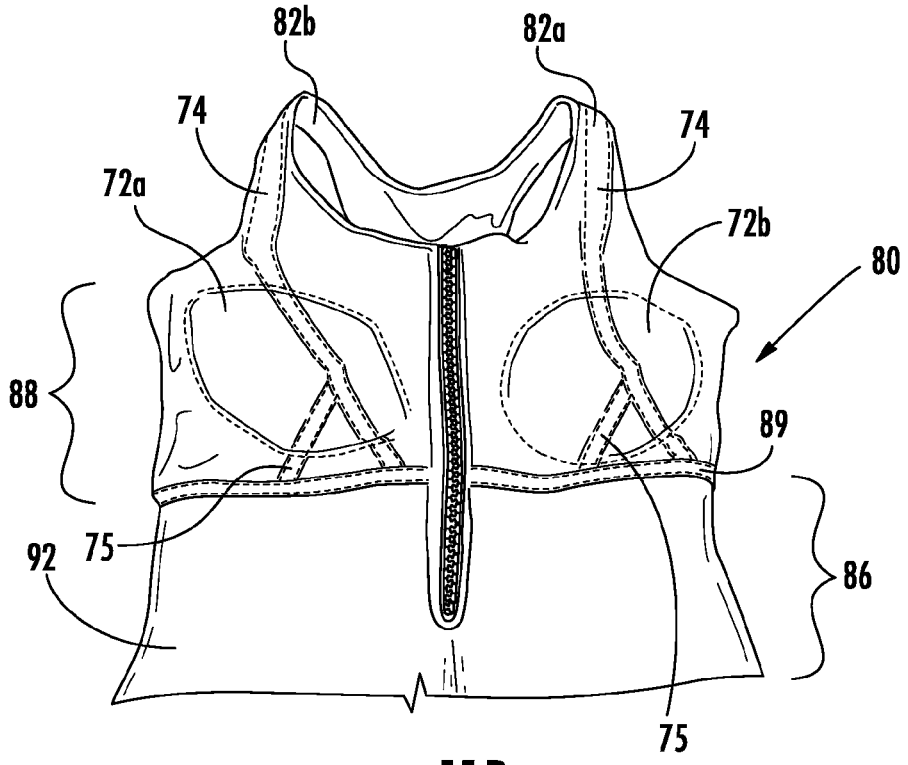
FIG. 11*b* is a view of the interior front portion of the garment embodiment of FIG. 11*a*.
Figure 11C:
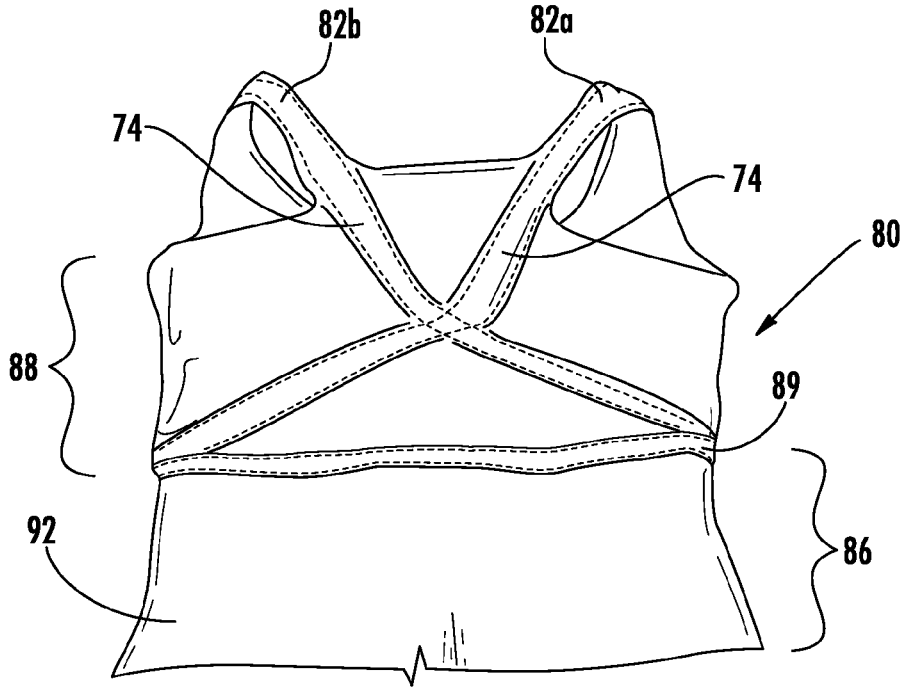
FIG. 11*c* is a view of the interior rear portion of the garment embodiment of FIG. 11*a*.
Figure 12A:
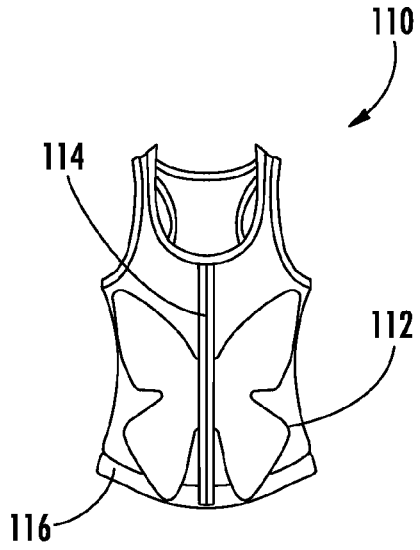
FIG. 12*a* is a front view of another garment embodiment.
Figure 12B:
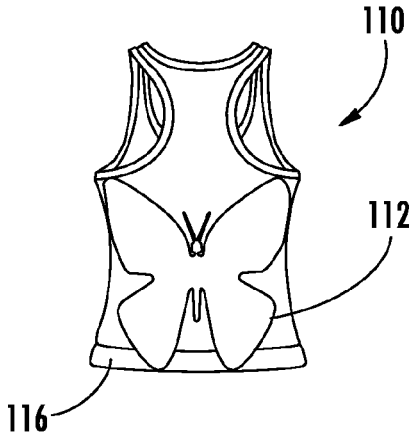
FIG. 12*b* is a rear view of the garment embodiment of FIG. 12*a*.

Referring now to FIGS. 12*a* and 12*b*, yet another garment embodiment 110 is shown, which is preferably similar to the jumpsuit embodiment shown in FIGS. 11*a*-11*c*, except that the perspiration promoting material 112 has been modified to adopt an ornamental shape, such as an animal and more specifically, a butterfly. Some portions of the perspiration promoting material 112 also extend to the breast section and may not cover the entire midsection portion. It is noted that various other ornamental shapes may be adopted, including depictions on living and non-living things as well as abstract arts.

Another difference to the jumpsuit embodiment shown in FIGS. 11*a*-11*c* is that the slit has been replaced with a full length opening 114. The full length opening may be opened and closed by a closure assembly, such as a zipper or the closure assembly disclosed in FIG. 14 below. Yet another difference to the jumpsuit embodiment shown in FIGS. 11*a*-11*c* is the elimination of the pair of short pants. Finally, an absorbent lining 116 may be added, which may be the same as the absorbent lining 11 described above. The absorbent lining 116 may be configured to catch and absorb the sweat of the user.

Figure 13A:
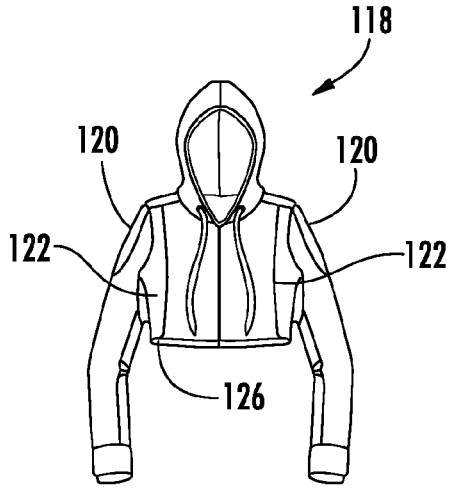
FIG. 13*a* is a front view of another garment embodiment.
Figure 13B:
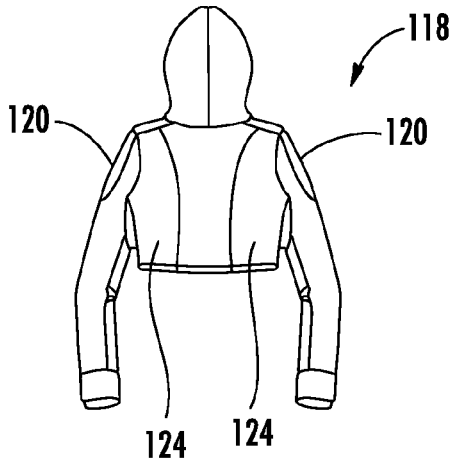
FIG. 13*b* is a rear view of the garment embodiment of FIG. 13*a*.

Referring now to FIGS. 13*a* and 13*b*, yet another embodiment 118 is shown, which is preferably similar to the jacket embodiment 30 of FIGS. 5*a*-5*c* except that shoulder perspiration promoting materials 120 are preferably added to the shoulder area of the clothing configured to contact the user's shoulders. Side perspiration promoting materials 122 are preferably also added to the side area of the clothing configured to contact the side area of the user. The side area may be the area delineated in FIG. 13*a* and may include the areas around the armpit, such as a portion of the shoulder area, the chest, and below the armpit. Back perspiration promoting materials 124 are preferably also added to the back area of the clothing configured to contact the back of the user. The back perspiration promoting materials 124 may cover the entire back of the garment or just the sides of the back as delineated in FIG. 13*b*. Mesh materials 126 may also be provided below the user's underarm area to provide vent to the armpit.

Figure 14:
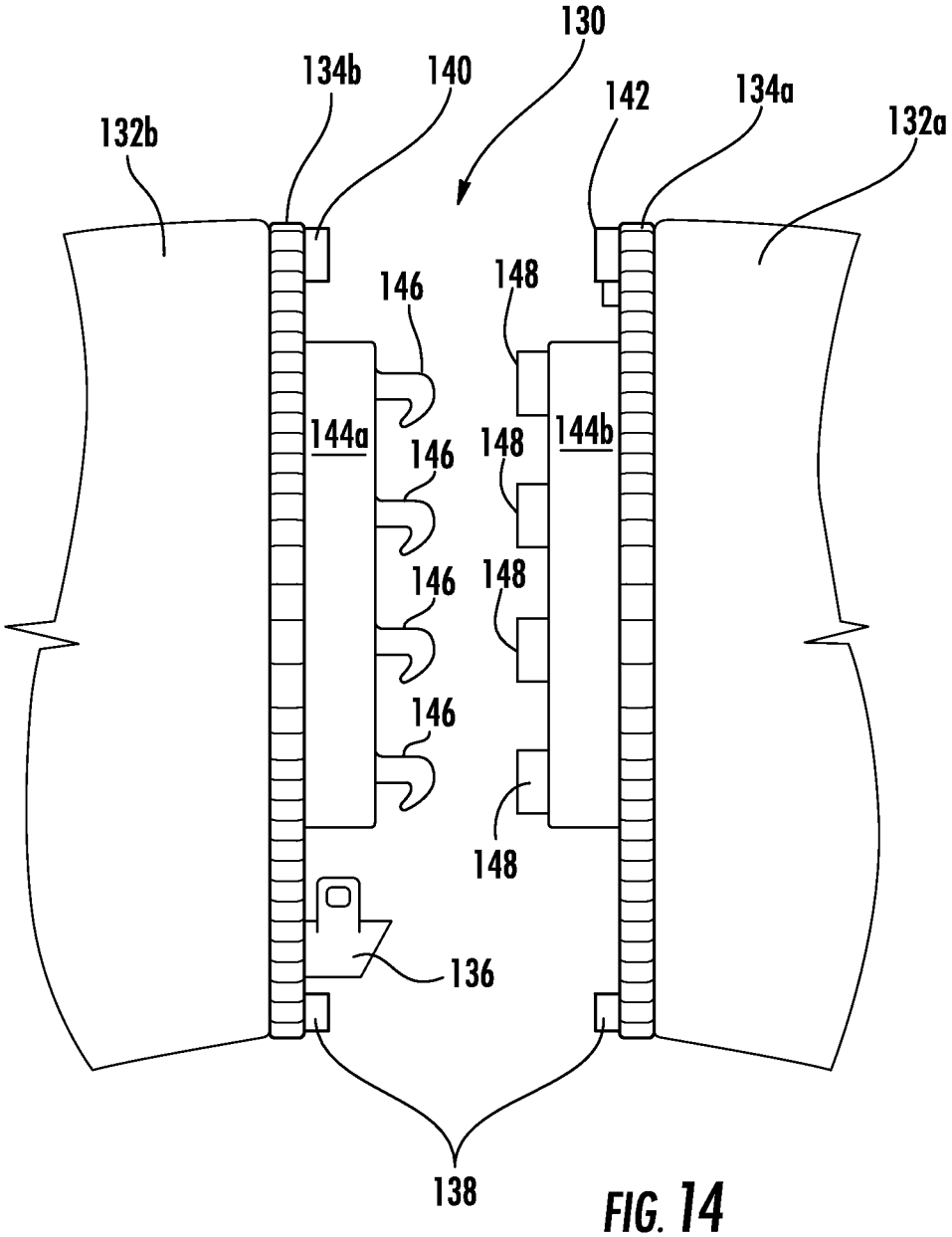
FIG. 14 is a schematic view of a clothing closure assembly that may be used with the various garment embodiments disclosed.

Referring now to FIG. 14, a closure assembly 130 is provided and may be used with any of the various embodiments already discussed. Closure assembly 130 preferably includes a pair of zipper tapes 132*a* and 132*b* configured to be attached to the periphery of the top portions that define the slit or the full length openings. The zipper tapes preferably include their respective set of zipper teeth 134*a* and 134*b*, which may interlock and work together to open and close the slit or the full length opening upon sliding the zipper slide 136. A pin 140 and a box 142 may be provided at the upper end of the zipper tape, which may be joined to begin closing the zipper. A pair of stops 138 may be provided at a lower end of the zipper tape where the zipper slide 136 may stop. The closure assembly 130 may further include a pair of flaps 144*a* and 144*b* attached to their respective zipper tapes. One or more hooks 146 may be attached along the length of the flap 144. One or more eyes 148 may be paired with the respective hooks 146 to receive the respective hooks and assist in closing the slit or full length openings. It can be realized that when a garment fits tightly to a user, the combination of the hooks and the eyes may be used first to close the slit or the opening, which may make it easy for the user to close the zipper. The combination of the hooks and the eyes may also minimize the wear on the zipper and may provide durability to the zipper.

It can be realized that the present disclosure provides various clothing embodiments that may be used both for fashion and for weight loss. The various clothing embodiments provide perspiration promoting materials strategically positioned at areas where excess fats or fluids may be reduced. The perspiration promoting materials may be discreetly hidden to provide aesthetically pleasing outfits. The various clothing embodiments may further provide superior support for the breasts, through the bra cups and the elastic bands, which allow the clothing embodiments to serve as excellent workout outfits, especially when combined with the perspiration promoting materials. The various clothing embodiments provide a variety of designs or selection for the users to choose in terms of fashion and functionality. Various designs are offered for various seasons, style, or weight loss needs.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A top garment configured to cover an upper body of a user, the top garment including a breast portion configured to cover breasts of the user, the top garment comprising:

a pair of bra cups for supporting the user's breasts;

a pair of elastic bands for each bra cup for aiding the bra cups in supporting the user's breasts, each elastic band being attached to and crossing a center of each of the bra cups; and a neoprene material attached to the pair of bra cups for promoting perspiration of the user, wherein the neoprene material surrounds a user's abdomen and causes perspiration of the user's abdomen.

2. The top garment of claim 1 wherein the neoprene material contacts the user's abdomen.

3. The top garment of claim 1 further comprising a nylon material positioned opposite to the neoprene material, the nylon material configured to cover the neoprene material.

4. The top garment of claim 1 further comprising a second neoprene material portion below a user's arm and is adapted to cause perspiration of the user's arm.

5. The top garment of claim 1 further comprising a hood for covering a user's head.

6. The top garment of claim 1, wherein the neoprene material surrounding the user's abdomen resembles an animal's body shape.

7. A top garment configured to cover an upper body of a user, the top garment having a side portion and comprising:

a bra cup for supporting a breast of the user;

a sleeve attached to the side portion for covering an arm of the user, the sleeve including an internal portion directly contacting the user's arm and an external portion opposite the internal portion; and a neoprene material positioned on the internal portion of the sleeve, the neoprene material configured to cause the arm of the user to perspire.

8. The top garment of claim 7 further comprising a spandex material covering the neoprene material, the spandex material serving as an external portion of the top garment.

9. The top garment of claim 7 further comprising a second neoprene material for contacting an abdomen of the user.

10. The top garment of claim 7 further comprising a hood for covering a user's head.

11. The top garment of claim 7 wherein the top includes a side neoprene material positioned to contact a side of a user's body and configured to promote perspiration of the user's side.

12. The top garment of claim 7 wherein the top includes a back neoprene material positioned to contact a portion of a user's back and configured to promote perspiration of said portion.

13. The top garment of claim 7 wherein the top includes a shoulder neoprene material positioned to contact a user's shoulder and configured to promote perspiration of said shoulder.

14. The top garment of claim 7 wherein the top defines an opening and further comprising a closure assembly for the opening, the closure assembly comprising:

a first zipper tape attached a first portion of the top defining the opening;

a set of zipper teeth lined along the first zipper tape;

a first flap attached to the first zipper tape;

at least one hook attached to the first flap;

a second zipper tape attached a second portion of the top defining the opening;

a set of zipper teeth lined along the second zipper tape configured to operate with the set of zipper teeth lined along the second zipper tape to open and close the opening;

a second flap attached to the second zipper tape; and at least one eye attached to the second flap, the hook configured to attach to the eye to join the first portion and the second portion of the top defining the opening.

15. An article of clothing comprising:

a top garment having a front portion and a rear portion, the front portion covering a breast of a user and including a bra cup for supporting the breast;

a shoulder strap attached to the top garment;

an elastic band attached to the bra cup and extending to the shoulder strap and the rear portion to assist the bra cup in supporting the breast; and a bottom garment attached to the top garment and configured to cover at least a portion of a user's legs, the bottom garment including a neoprene material positioned on an internal side of the bottom garment and configured to contact a waist of the user and promote perspiration of the user's waist.

16. The clothing of claim 15 wherein the neoprene material contacts a user's lower abdomen.

17. The clothing of claim 15 wherein the neoprene material contacts a user's body from a user's lower abdomen to a user's knee.

18. The clothing of claim 15, wherein the top garment defines an opening and further comprising a closure assembly for the opening, the closure assembly comprising:

a first zipper tape attached a first portion of the top garment defining the opening;

a set of zipper teeth lined along the first zipper tape;

a first flap attached to the first zipper tape;

at least one hook attached to the first flap;

a second zipper tape attached a second portion of the top garment defining the opening;

a set of zipper teeth lined along the second zipper tape configured to operate with the set of zipper teeth lined along the second zipper tape to open and close the opening;

a second flap attached to the second zipper tape; and at least one eye attached to the second flap, the hook configured to attach to the eye to join the first portion and the second portion of the top garment defining the opening.

* * * * *